US010088254B2

(12) United States Patent
Wang

(10) Patent No.: US 10,088,254 B2
(45) Date of Patent: Oct. 2, 2018

(54) ADJUSTABLE REFRIGERANT DISTRIBUTION DEVICE AND HEAT EXCHANGER HAVING SAME

(71) Applicant: SANHUA (HANGZHOU) MICRO CHANNEL HEAT EXCHANGER CO., LTD., Hangzhou (CN)

(72) Inventor: Leilei Wang, Hangzhou (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 199 days.

(21) Appl. No.: 15/314,045

(22) PCT Filed: Oct. 23, 2014

(86) PCT No.: PCT/CN2014/089263
§ 371 (c)(1),
(2) Date: Nov. 25, 2016

(87) PCT Pub. No.: WO2015/180388
PCT Pub. Date: Dec. 3, 2015

(65) Prior Publication Data

US 2017/0184355 A1 Jun. 29, 2017

(30) Foreign Application Priority Data

May 26, 2014 (CN) ..... 2014 1 0229143

(51) Int. Cl.
*F28F 27/02* (2006.01)
*F28F 9/22* (2006.01)
(Continued)

(52) U.S. Cl.
CPC ..... *F28F 27/02* (2013.01); *F25B 39/00* (2013.01); *F28F 9/0273* (2013.01); *F28F 9/22* (2013.01);
(Continued)

(58) Field of Classification Search
CPC ..... F28F 9/00; F28F 9/02; F28F 9/026; F28F 9/027; F28F 9/0273; F28F 9/0275;
(Continued)

(56) References Cited

U.S. PATENT DOCUMENTS 4,365,175 A * 12/1982 Eckels ..... F25B 9/04 165/104.19
6,889,521 B2 * 5/2005 Seno ..... F25B 39/04 62/506
(Continued)

FOREIGN PATENT DOCUMENTS

CN 103486896 A 1/2014
CN 104048548 A 9/2014
(Continued)

OTHER PUBLICATIONS

International Search Report and Written Opinion of the ISA for International Application No. PCT/CN2014/089263, dated Mar. 3, 2015.

*Primary Examiner* — Keith Raymond
*Assistant Examiner* — Gustavo Hincapie Serna
(74) *Attorney, Agent, or Firm* — Howard & Howard Attorneys PLLC

(57) ABSTRACT

An adjustable refrigerant distribution device and a heat exchanger having same. The heat exchanger comprises: first and second collecting pipes; a heat exchanger core body; and a refrigerant distribution device, the refrigerant distribution device comprises a first distribution pipe, a first inlet pipe and a first drive assembly. The pipe wall of the first distribution pipe is provided with a first distribution hole. The first distribution pipe is inserted into at least one of the first and the second collecting pipes. The first inlet pipe is located outside at least one collecting pipe and is in communication with the first distribution pipe, and the first drive assembly drives the first distribution pipe to move relative to
(Continued)

at least one collecting pipe. The distribution pipe of the refrigerant distribution device and the heat exchanger can translate along the axial direction, thereby adjusting refrigerant distribution so as to satisfy different distribution requirements.

17 Claims, 4 Drawing Sheets

(51) Int. Cl.

| | |
|---|---|
| ***F25B 39/00*** | (2006.01) |
| ***F28F 9/02*** | (2006.01) |
| *F25B 39/02* | (2006.01) |
| *F28D 1/053* | (2006.01) |

(52) U.S. Cl.
CPC ..... *F25B 39/028* (2013.01); *F25B 2700/2117* (2013.01); *F28D 1/05316* (2013.01)

(58) Field of Classification Search
CPC ... F28F 9/22; F28F 27/02; F25B 39/00; F25B 39/02; F25B 39/028; F25B 2700/2117; F28D 1/05316; F28D 1/05325
USPC ..... 165/172, 173, 174, 200, 287, 288, 294; 62/525, 527, 528
See application file for complete search history.

(56) References Cited

U.S. PATENT DOCUMENTS

| | | | | |
|---|---|---|---|---|
| 7,086,249 | B2 * | 8/2006 | Bae | F25B 39/022 165/173 |
| 7,143,605 | B2 * | 12/2006 | Rohrer | F25B 5/02 62/515 |
| 7,967,060 | B2 * | 6/2011 | Trumbower | F25B 39/028 165/174 |
| 8,561,680 | B2 * | 10/2013 | Jiang | F28D 1/05366 165/174 |
| 9,568,225 | B2 * | 2/2017 | Chowdhury | F25B 39/02 |
| 9,746,255 | B2 * | 8/2017 | Xia | F28F 9/0273 |
| 9,903,667 | B2 * | 2/2018 | Seo | F28F 1/12 |
| 2006/0070401 | A1 | 4/2006 | Bae et al. | |
| 2008/0093051 | A1 * | 4/2008 | Rios | F25B 41/067 165/61 |
| 2011/0000255 | A1 * | 1/2011 | Taras | F25B 39/028 62/498 |
| 2011/0017438 | A1 * | 1/2011 | Huazhao | F25B 39/028 165/174 |
| 2011/0203308 | A1 * | 8/2011 | Chiang | F25B 39/028 62/498 |
| 2016/0161197 | A1 | 6/2016 | Gao et al. | |

FOREIGN PATENT DOCUMENTS

| | | |
|---|---|---|
| GB | 2250336 A | 6/1992 |
| KR | 101217454 B1 | 1/2013 |

* cited by examiner

ADJUSTABLE REFRIGERANT DISTRIBUTION DEVICE AND HEAT EXCHANGER HAVING SAME

CROSS-REFERENCE TO RELATED APPLICATIONS

The present application is a National Stage of International Patent Application No. PCT/CN2014/089263, filed on Oct. 23, 2014, which claims priority to and all the benefits of Chinese Patent Application No. 201410229143.X, filed on May 26, 2014, both of which are hereby expressly incorporated herein by reference in their entirety.

BACKGROUND OF THE INVENTION

1. Field of the Invention

The present invention relates to a technical field of heat exchangers, and particularly, to an adjustable refrigerant distribution device and a heat exchanger having same.

2. Description of the Related Art

In a refrigerant circulation process, an overcooled refrigerant from a condenser is depressurized via a throttling device to an evaporation pressure and an evaporation temperature, and then enters an evaporator. The refrigerant becomes a gas-liquid two-phase refrigerant after adiabatic throttling, and the vapor content makes up about 10% to 30% of the total mass of the refrigerant. For the gas-liquid two-phase refrigerant, due to differences between liquid and gas in density, viscosity and other physical properties, the inertia and gravity have different degrees of influences on the liquid refrigerant and the gas refrigerant, and hence the refrigerant may encounter a gas-liquid stratification phenomenon after entering a heat exchanger, like a parallel flow heat exchanger (a microchannel heat exchanger), which leads to an uneven refrigerant distribution in flat tubes—dry evaporation occurring in a part of the flat tubes but too much liquid supplied in another part of the flat tubes, thus degrading a heat exchange performance of the heat exchanger.

In the prior art, it has been proposed to insert a refrigerant distribution pipe into a header, so that the refrigerant enters the header through a distribution hole in the refrigerant distribution pipe and hence is distributed to the flat tubes. However, some defects still exist in the refrigerant distribution pipe of the prior art, and a requirement for improvement is present.

The present application is made by the inventor based on findings and knowledge about the following facts and problems.

In the related art, the refrigerant distribution pipe is inserted into the header, which may improve uniformity of the refrigerant distribution, but it is found through a great deal of studies and experiments that a dryness, a flow rate and a flow direction of the refrigerant at an inlet of the header, a location of an refrigerant inlet on the header, the number of flat tubes, a depth by which the flat tubes are inserted into the header and other factors have significant influences on the uniform distribution of the refrigerant. Therefore, it is required to determine the refrigerant distribution pipe according to an operating condition of the heat exchanger and after repeated installation, redesign and repeated tests. However, the refrigerant distribution pipe cannot be adjusted accordingly as the operating condition of the heat exchanger varies, so it is impossible to satisfy the refrigerant distribution requirements of the heat exchanger under different operating conditions.

SUMMARY OF THE INVENTION

The present invention aims to solve at least one of the above technical problems in the related art to at least some extent. Accordingly, an objective of the present invention is to provide a refrigerant distribution device whose distribution pipe may be translated, thus adjusting the refrigerant distribution so as to satisfy different distribution requirements.

Another objective of the present invention is to further provide a heat exchanger having the above refrigerant distribution device.

To achieve the above objectives, a heat exchanger is provided according to embodiments of the present invention, and includes: a first header and a second header; a heat exchanger core including a heat exchange tube and a fin, wherein two ends of the heat exchange tube are connected with the first header and the second header respectively, and the fin is disposed between adjacent heat exchange tubes; and a refrigerant distribution device including a first distribution pipe, a first inlet pipe and a first drive assembly. A pipe wall of the first distribution pipe is provided with first distribution holes. The first distribution pipe is inserted into at least one of the first header and the second header. The first inlet pipe is located outside the at least one of the first header and the second header and communicated with the first distribution pipe. The first drive assembly drives the first distribution pipe to move relative to the at least one of the first header and the second header.

For the heat exchanger according to embodiments of the present invention, the first drive assembly is provided to drive the first distribution pipe to move relative to the first header, a relative position of the first distribution hole and the first header may be adjusted based on the operating condition of the heat exchanger at any time, thereby adjusting the refrigerant distribution so as to satisfy the requirement for the uniform refrigerant distribution of the multichannel heat exchanger under different operating conditions.

According to an embodiment of the present invention, the heat exchanger further includes a temperature sensor disposed to the heat exchanger core and connected with the first drive assembly, wherein the first drive assembly drives the first distribution pipe to move according to a temperature detected by the temperature sensor.

According to an embodiment of the present invention, a plurality of temperature sensors are provided, spaced apart from one another, and disposed at different positions on the heat exchanger core, and the first drive assembly drives the first distribution pipe to move according to a difference of temperatures detected by the plurality of temperature sensors.

According to an embodiment of the present invention, the refrigerant distribution device further includes a first communicating chamber body, wherein the first communicating chamber body defines a first communicating chamber therein, the first distribution pipe passes through the first communicating chamber body to be connected with the first drive assembly, the first distribution pipe is in communication with the first communicating chamber, and the first inlet pipe is connected with the first communicating chamber body and communicated with the first distribution pipe through the first communicating chamber.

According to an embodiment of the present invention, the refrigerant distribution device further comprises a fixed distribution pipe disposed inside the at least one of the first header and the second header and provided with fixed distribution holes, wherein the first distribution pipe is inserted into the fixed distribution pipe and moves relative to the fixed distribution pipe under the drive of the first drive assembly.

According to an embodiment of the present invention, the refrigerant distribution device further includes a second distribution pipe, a second inlet pipe and a second drive assembly, wherein a pipe wall of the second distribution pipe is provided with second distribution holes, the second distribution pipe is inserted into or fitted over the first distribution pipe, the second inlet pipe is located outside the at least one of the first header and the second header and communicated with the second distribution pipe, and the second drive assembly drives the second distribution pipe to move relative to the first distribution pipe.

According to an embodiment of the present invention, the first drive assembly includes one of an electronic expansion valve, an electric motor, an air cylinder or a hydraulic cylinder.

According to an embodiment of the present invention, the first drive assembly includes: a stator; a rotor rotatably disposed within the stator and having threads in an inner surface thereof; and a moving member threadedly fitted with the rotor and that moves through rotation of the rotor.

According to an embodiment of the present invention, the first drive assembly drives the first distribution pipe to translate relative to the at least one of the first header and the second header along an axial direction thereof.

According to an embodiment of the present invention, the first drive assembly drives the first distribution pipe to rotate relative to the at least one of the first header and the second header.

According to an embodiment of the present invention, the first distribution holes include a first row of distribution holes adjacent to a first end of the first distribution pipe and a second row of distribution holes adjacent to a second end of the first distribution pipe, and the first row of distribution holes are staggered with the second row of distribution holes in a circumferential direction of the first distribution pipe.

A refrigerant distribution device is provided according to embodiments of the present invention, and includes a distribution pipe, an inlet pipe and a drive assembly, wherein a pipe wall of the distribution pipe is provided with a distribution hole, the inlet pipe is in communication with the distribution pipe, and the drive assembly drives the distribution pipe to move.

The distribution pipe of the refrigerant distribution device according to embodiments of the present invention may be translated, thus adjusting the refrigerant distribution so as to satisfy different distribution requirements.

According to an embodiment of the present invention, the refrigerant distribution device further includes a communicating chamber body, wherein the communicating chamber body defines a communicating chamber therein, the distribution pipe passes through the communicating chamber body to be connected with the drive assembly, the distribution pipe is in communication with the communicating chamber, and the inlet pipe is connected with the communicating chamber body and communicated with the distribution pipe through the communicating chamber.

According to an embodiment of the present invention, the refrigerant distribution device further includes a fixed distribution pipe provided with fixed distribution holes, wherein the distribution pipe is inserted into the fixed distribution pipe and moves relative to the fixed distribution pipe under the drive of the drive assembly.

According to an embodiment of the present invention, the drive assembly includes one of an electronic expansion valve, an electric motor, an air cylinder or a hydraulic cylinder.

According to an embodiment of the present invention, the drive assembly includes: a stator; a rotor rotatably disposed within the stator and having threads in an inner surface thereof; and a moving member threadedly fitted with the rotor and that translates through rotation of the rotor.

According to an embodiment of the present invention, the drive assembly drives the distribution pipe to translate and/or rotate.

BRIEF DESCRIPTION OF THE DRAWINGS

Other advantages of the invention will be readily appreciated as the same becomes better understood by reference to the following detailed description when considered in connection with the accompanying drawings, wherein.

Figure 1:
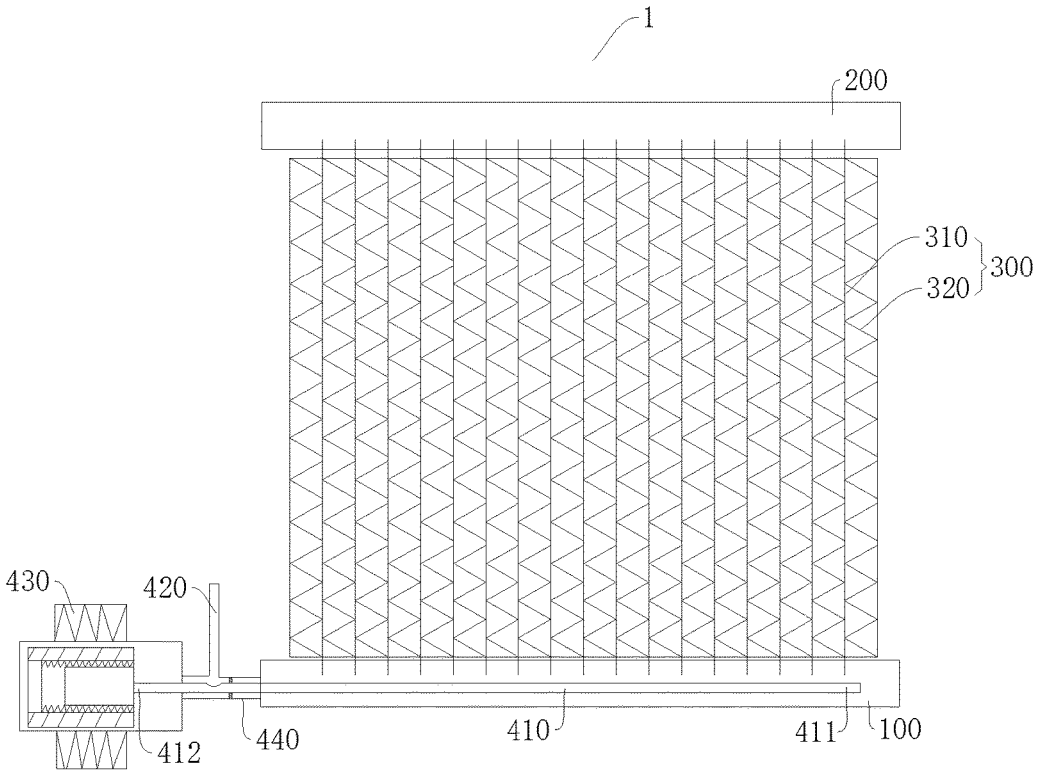
FIG. 1 is a schematic view of a heat exchanger according to an embodiment of the present invention.

REFERENCE NUMERALS heat exchanger 1, first header 100, second header 200, heat exchanger core 300, heat exchange tube 310, fin 320, refrigerant distribution device 400, first distribution pipe 410, first end 411 of first distribution pipe 410, second end 412 of first distribution pipe 410, first distribution hole 413, first inlet pipe 420, first drive assembly 430, stator 431, rotor 432, moving member 433, elastic member 434, casing 435, first communicating chamber body 440, first communicating chamber 441, partition plate 442, second distribution pipe 450, first end 451 of second distribution pipe 450, second end 452 of second distribution pipe 450, second distribution hole 453, second inlet pipe 460, second drive assembly 470, second communicating chamber body 480, fixed distribution pipe 600, fixed distribution hole 610, connector 700, cavity 710.

DETAILED DESCRIPTION OF THE INVENTION

Embodiments of the present invention will be described in detail and examples of the embodiments will be illustrated in the accompanying drawings. The same or similar elements and the elements having same or similar functions are denoted by like reference numerals throughout the descriptions. The embodiments described herein with reference to the drawings are explanatory, which aim to illustrate the present invention, but shall not be construed to limit the present invention.

The inventor of the present application finds that, for a heat exchanger in the related art, like a parallel flow heat exchanger, although a refrigerant distribution pipe is inserted into a header to improve uniformity of the refrigerant distribution, but a dryness, a flow rate and a flow direction of the refrigerant at an inlet of the header, a location of an refrigerant inlet on the header, the number of heat exchange tubes (like flat tubes), a depth by which the flat tube is inserted into the header and other factors have significant influences on the uniform distribution of the refrigerant. Consequently, the refrigerant distribution pipe cannot be adjusted accordingly as an operating condition of the heat exchanger varies, so it is impossible to satisfy the refrigerant distribution requirements of the heat exchanger under different operating conditions.

Therefore, embodiments of the present invention provide a heat exchanger and a refrigerant distribution device thereof, so as to at least partially overcome the above technical problems in the related art.

In the following, a heat exchanger 1 according to embodiments of the present invention will be described in detail with reference to the drawings.

As shown in FIGS. 1 to 8, the heat exchanger 1 according to embodiments of the present invention includes a first header 100, a second header 200, a heat exchanger core 300 and a refrigerant distribution device 400.

The heat exchanger core 300 includes a heat exchange tube 310 and a fin 320. Preferably, the heat exchange tube 310 is a flat tube. Two ends of the heat exchange tube 310 are connected with the first header 100 and the second header 200 respectively, such that a refrigerant passage inside the heat exchange tube 310 communicates an internal chamber of the first header 100 with that of the second header 200. The fin 320 is disposed between adjacent heat exchange tubes 310.

The refrigerant distribution device 400 according to embodiments of the present invention includes a distribution pipe, an inlet pipe and a drive assembly. In order to facilitate discrimination in the following description of the embodiments, a first distribution pipe 410, a first inlet pipe 420, a first drive assembly 430 are taken as examples for description.

A pipe wall of the first distribution pipe 410 is provided with a plurality of first distribution holes 413 spaced apart from one another along an axial direction of the first distribution pipe 410. It can be understood by those skilled in the art that the number of the first distribution holes 413, angles of the first distribution holes 413 and spaces among the first distribution holes 413 may be set according to specific applications and requirements. A first end 411 of the first distribution pipe 410 is inserted into at least one of the first header 100 and the second header 200, and a second end 412 of the first distribution pipe 410 extends out of the at least one of the first header 100 and the second header 200. The first inlet pipe 420 is located outside the at least one of the first header 100 and the second header 200 and communicated with the first distribution pipe 410.

The first drive assembly 430 is connected with the second end 412 of the first distribution pipe 410, so as to drive the first distribution pipe 410 to move relative to the at least one of the first header 100 and the second header 200.

As shown in FIGS. 1 to 5, it is taken as an example to insert the first end 411 of the first distribution pipe 410 into the first header 100, the second end 412 of the first distribution pipe 410 extends out of the first header 100, and the first inlet pipe 420 is located outside the first header 100 and communicated with the first distribution pipe 410. The first drive assembly 430 is connected with the first distribution pipe 410, and the first distribution pipe 410 is driven by the first drive assembly 430 to move relative to the first header 100.

It can be understood that the first distribution pipe 410 may also be inserted into the second header 200, and alternatively, the first header 100 and the second header 200 each are provided with the first distribution pipe 410. In other words, the first header 100 is provided with the refrigerant distribution device 400, or the second header 200 is provided with the refrigerant distribution device 400, or the first header 100 and the second header 200 each are provided with the refrigerant distribution device 400 simultaneously.

In the following, a refrigerant distribution process of the heat exchanger 1 according to embodiments of the present invention will be described with focus on an example where the refrigerant distribution device is disposed inside the first header 100, i.e. the first distribution pipe 410 is disposed inside the first header 100.

When an operating condition of the heat exchanger 1 varies, the original refrigerant distribution scheme cannot meet the refrigerant distribution requirement under a new operating condition. For example, the heat exchange tube 310 around a proximal end (a left end in FIG. 1) of the first header 100 close to an inlet of the first header 100 may be supplied with too much liquid, and due to a usually constant refrigerant flow rate, the heat exchange tube 310 away from the proximal end of the first header 100 has an insufficient liquid supply or a dry evaporation phenomenon. In such a case, the first distribution pipe 410 may be driven by the first drive assembly 430 to move relative to the first header 100, so as to reduce the refrigerant flow rate at the proximal end of the first header 100 and increase the refrigerant flow rate around a distal end of the first header 100 away from the inlet of the first header 100, thus achieving a purpose of uniform refrigerant distribution.

For the heat exchanger 1 according to embodiments of the present invention, by providing the first drive assembly 430 connected with the first distribution pipe 410 that drives the first distribution pipe 410 to move relative to the first header 100, relative positions of the first distribution holes 413 in the first distribution pipe 410 with respect to respective heat exchange tubes 310 may be adjusted based on the operating condition of the heat exchanger 1, thereby adjusting the refrigerant distributed to the respective heat exchange tubes 310 so as to satisfy the refrigerant distribution requirements of the heat exchanger 1 under different operating conditions.

The heat exchanger 1 according to specific embodiments of the present invention will be described below with reference to the drawings, and for ease of understanding, it is taken as an example to insert the first distribution pipe 410 into the first header 100 for description.

As shown in FIG. 1, the heat exchanger 1 according to some specific embodiments of the present invention includes the first header 100, the second header 200, the heat exchanger core 300, the refrigerant distribution device 400 and a temperature sensor (not shown).

The temperature sensor is disposed to the heat exchanger core 300 and connected with the first drive assembly 430. The first drive assembly 430 drives the first distribution pipe 410 to move according to a temperature detected by the temperature sensor. During the operation of a heat exchange system including the heat exchanger 1, the heat exchanger 1 according to embodiments of the present invention may adjust the refrigerant distribution process automatically according to the practical operating conditions, thus eliminating the need for mounting and dismounting, testing and redesigning processes of conventional distribution pipes, and reducing the design time, material cost and labor cost of product development. In other words, the first drive assembly 430 may drive the first distribution pipe 410 to move according to the temperature detected by the temperature sensor, thus adjusting the refrigerant distribution so as to satisfy the requirement of the current operating condition. It can be understood that the first drive assembly 430 may be connected with the temperature sensor through a controller, such that the controller controls the first drive assembly 430 to drive the first distribution pipe 410 to move according to the temperature detected by the temperature sensor. The controller may be a member independent from the first drive assembly 430 or be regarded as a constituent part of the first drive assembly 430.

Preferably, a plurality of temperature sensors are provided, spaced apart from one another, and disposed at different positions on the heat exchanger core 300, so as to detect temperatures at the different positions on the heat exchanger core 300. The first drive assembly 430 may drive the first distribution pipe 410 to move according to a difference of temperatures detected by the plurality of temperature sensors.

For example, when the operating condition of the heat exchange tubes 310 changes, an obvious temperature difference will show between surfaces of different heat exchange tubes 310 of the heat exchanger 1 at the same level, and the plurality of temperature sensors convert temperature detection values at the different positions into electrical signals to be sent to a microprocessor of the controller. The microprocessor makes a judgment based on the electrical signals and sends a pulse signal to the first drive assembly 430, and the first drive assembly 430 drives the first distribution pipe 410 to move according to the pulse signal, thereby adjusting the refrigerant distribution.

In some examples of the present invention, the first drive assembly 430 may include one of an electronic expansion valve, an electric motor, an air cylinder or a hydraulic cylinder.

Figure 2:
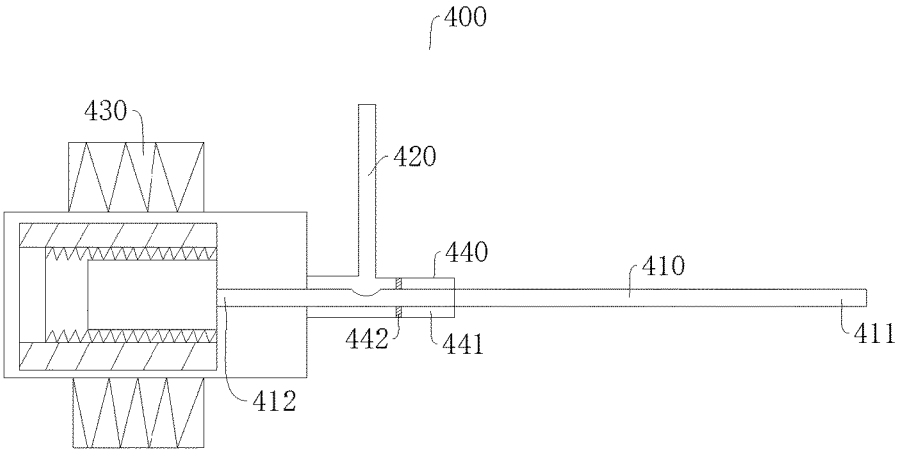
FIG. 2 is a schematic view of a refrigerant distribution device according to an embodiment of the present invention.

In the following, the description will focus on an example where the first drive assembly 430 is the electronic expansion valve. As shown in FIG. 2, the second end 412 of the first distribution pipe 410 is fixedly connected with a valve rod of the electronic expansion valve, like via threaded connection, i.e. the second end 412 of the first distribution pipe 410 is provided with external threads and the valve rod is provided with internal threads. Alternatively, the second end 412 of the first distribution pipe 410 may be provided with internal threads, while the valve rod may be provided with external threads.

The second end 412 of the first distribution pipe 410 is closed to allow the refrigerant entering the first distribution pipe 410 to flow into the first header 100 along the first distribution pipe 410 through the first distribution holes 413. The electronic expansion valve is utilized to control the movement of the first distribution pipe 410 accurately and stably, thus achieving controllability and accuracy of refrigerant distribution adjustment. Certainly, it can be understood by those skilled in the art that when the electronic expansion valve is used as the first drive assembly 430, the structure of the electronic expansion valve may be modified adaptively according to particular applications. For example, an inlet and an outlet of the electronic expansion valve are closed, i.e. only a driving function of the electronic expansion valve is utilized, without using its throttling function.

Figure 3:
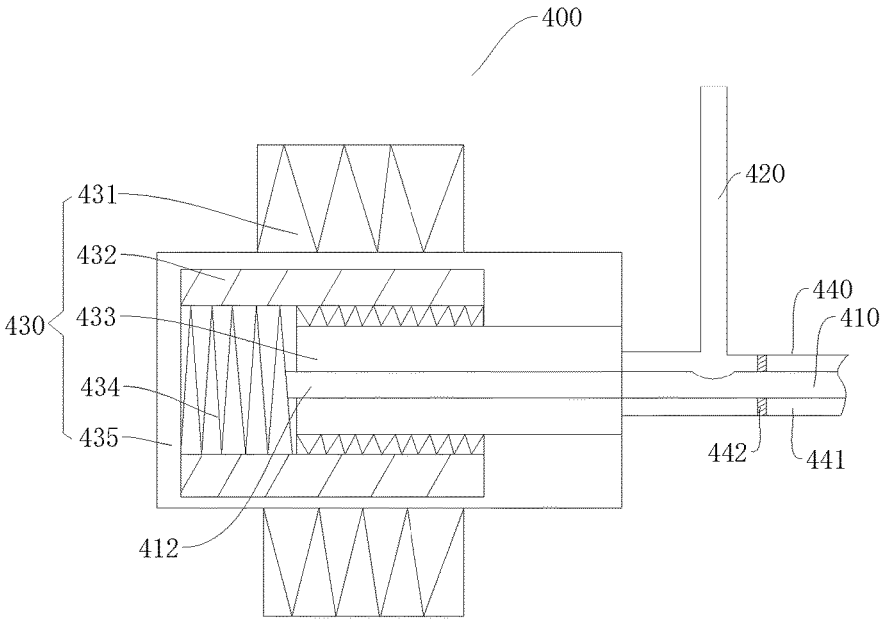
FIG. 3 is a schematic view of a refrigerant distribution device according to another embodiment of the present invention.

As shown in FIG. 3, another example of the first drive assembly 430 is shown. The first drive assembly 430 includes a casing 435, a stator 431, a rotor 432, a moving member 433 and an elastic member 434. The casing 435 defines a cavity therein. The stator 431 is disposed outside the casing 435. The rotor 432 is rotatably disposed within the cavity, and an inner surface of the rotor 432 has threads. The moving member 433 is threadedly fitted with the rotor 432, and may be translated through rotation of the rotor 432. The elastic member 434 is disposed between an inner wall of the cavity and the moving member 433, the second end 412 of the first distribution pipe 410 is connected with the elastic member 434, and the second end 412 of the first distribution pipe 410 is closed.

For example, the rotor 432 drives the moving member 433 to press the elastic member 434 when rotating clockwise, and the elastic member 434 is compressed and deformed, and drives the first distribution pipe 410 to move towards the proximal end of the first header 100 (e.g. moving leftwards in FIG. 1). When the rotor 432 rotates counterclockwise, the elastic member 434 is restored and pushes the first distribution pipe 410 to move towards the distal end of the first header 100.

It can be understood by those skilled in the art that, in order to convert the rotational motion of the rotor 432 into the translational movement of the moving member 433, any suitable measures may be taken to limit the rotation of the moving member 433 with the rotor.

For another example, the rotor 432 drives the moving member 433 to rotate clockwise when rotating clockwise, such that a part of the first distribution holes 413 of the first distribution pipe 410 face the heat exchange pipes 310 at the proximal end of the first header 100. The rotor 432 drives the moving member 433 to rotate counterclockwise when rotating counterclockwise, such that a part of the first distribution holes 413 of the first distribution pipe 410 face the heat exchange pipes 310 at the distal end of the first header 100.

In some specific embodiments of the present invention, as shown in FIGS. 1-4 and FIG. 6, preferably, a first communicating chamber body 440 is disposed between the first drive assembly 430 and the first header 100, in order to facilitate communication between the first inlet pipe 420 and the first distribution pipe 410. The first communicating chamber body 440 defines a first communicating chamber 441 therein, and the second end 412 of the first distribution pipe 410 passes through the first communicating chamber body 440 to be connected with the first drive assembly 430. The first distribution pipe 410 is in communication with the first communicating chamber 441, and the first inlet pipe 420 is connected with the first communicating chamber body 440 and communicated with the first distribution pipe 410 through the first communicating chamber 441.

That is, a portion of the first distribution pipe 410 is located inside the first communicating chamber 441 of the first communicating chamber body 440 and is provided with a through hole, and the first inlet pipe 420 is in communication with the first communicating chamber 441, such that the refrigerant enters the first communicating chamber 441 through the first inlet pipe 420 and then enters the first distribution pipe 410 via the through hole.

In a specific example, a partition plate 442 may be disposed within the first communicating chamber 411 and be provided with a hole fitted with the first distribution pipe 410, and the first distribution pipe 410 passes through the hole in the partition plate 442. During the movement of the first distribution pipe 410, all the refrigerant flowing out of the first inlet pipe 420 vertically enters the first distribution pipe 410.

Figure 4:
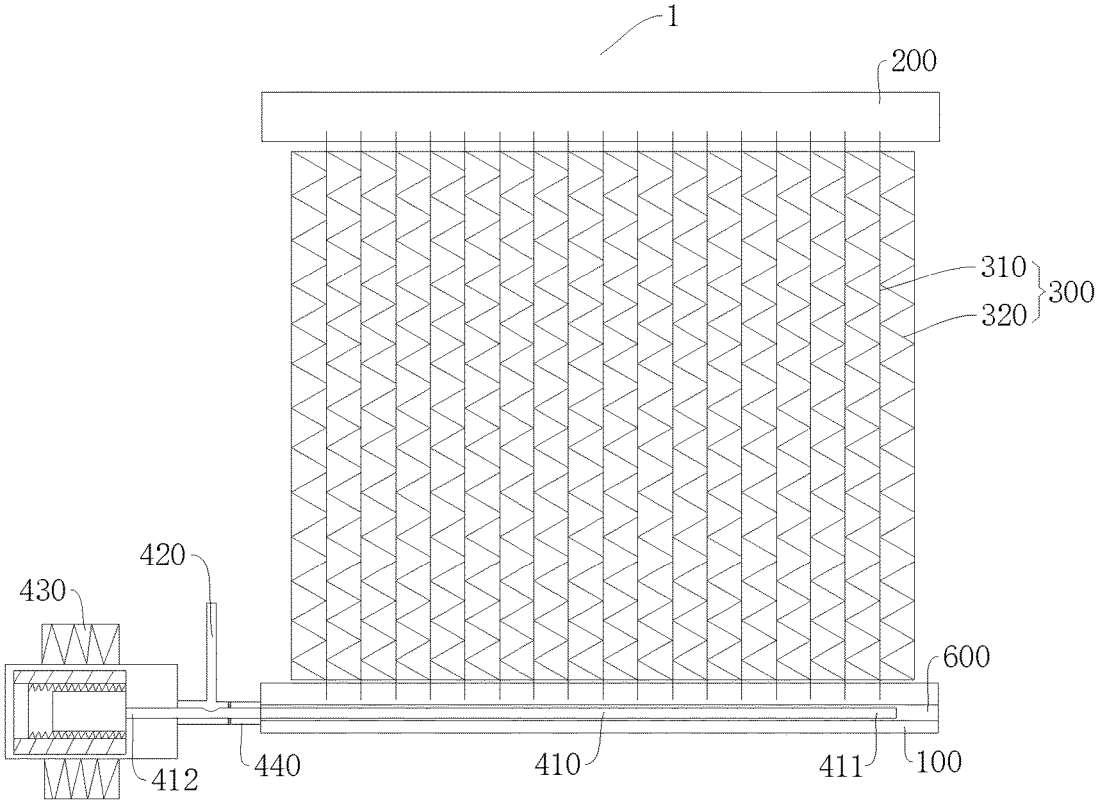
FIG. 4 is a schematic view of a heat exchanger according to another embodiment of the present invention.
Figure 5:
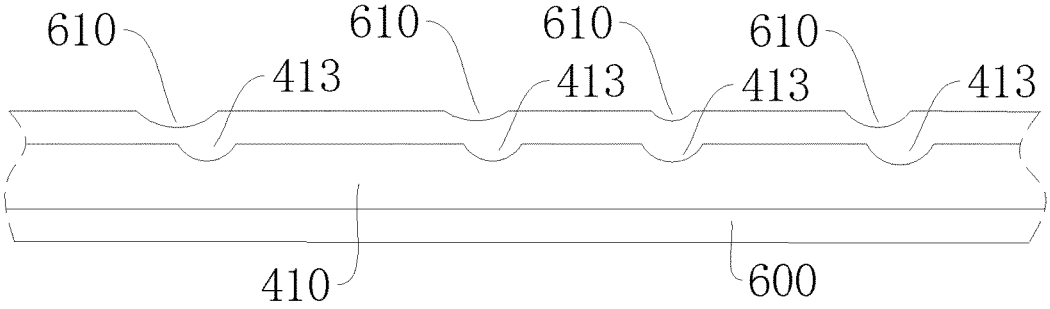
FIG. 5 is a partially enlarged view of FIG. 4.

In another specific embodiment of the present invention, as shown in FIGS. 4 and 5, the refrigerant distribution device 400 includes the first distribution pipe 410, the first inlet pipe 420, the first drive assembly 430 and a fixed distribution pipe 600.

FIG. 4 shows that the fixed distribution pipe 600 is disposed within the first header 100. The fixed distribution pipe 600 is provided with a plurality of fixed distribution holes 610 spaced apart from one another along an axial direction of the fixed distribution pipe 600. The pipe wall of the first distribution pipe 410 is provided with the plurality of first distribution holes 413 spaced apart from one another along the axial direction of the first distribution pipe 410. The first end 411 of the first distribution pipe 410 is inserted into the fixed distribution pipe 600, and the second end 412 of the first distribution pipe 410 extends out of the fixed distribution pipe 600. The first inlet pipe 420 is located outside the first header 100 and communicated with the first distribution pipe 410. The first drive assembly 430 is connected with the second end 412 of the first distribution pipe 410 to drive the first distribution pipe 410 to move relative to the fixed distribution pipe 600.

Therefore, an overlapping area of the first distribution hole 413 and the fixed distribution hole 610 may be adjusted to adjust the refrigerant distribution. Herein, the so-called fixed distribution pipe 600 means that the distribution pipe 600 may be fixed relative to the first header 100.

Figure 6:
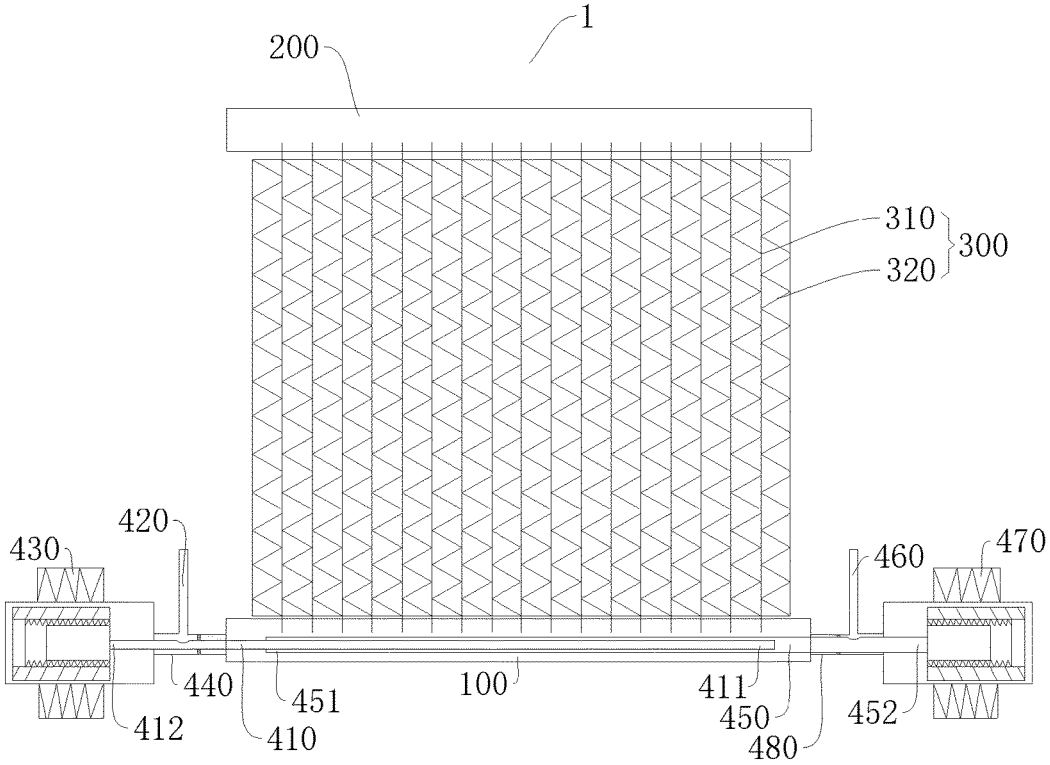
FIG. 6 is a schematic view of a heat exchanger according to another embodiment of the present invention.
Figure 7:
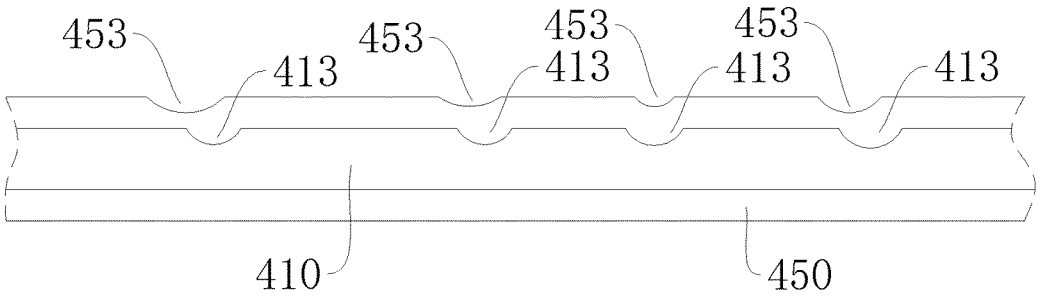
FIG. 7 is a partially enlarged view of FIG. 6.

In some specific examples of the present invention, as shown in FIGS. 6 and 7, the refrigerant distribution device 400 includes the first distribution pipe 410, the first inlet pipe 420, the first drive assembly 430, a second distribution pipe 450, a second inlet pipe 460, and a second drive assembly 470.

The pipe wall of the first distribution pipe 410 is provided with the plurality of first distribution holes 413 spaced apart from one another along the axial direction of the first distribution pipe 410. The first end 411 of the first distribution pipe 410 is inserted into at least one of the first header 100 and the second header 200, and the second end 412 of the first distribution pipe 410 extends out of the at least one of the first header 100 and the second header 200. The first inlet pipe 420 is located outside the at least one of the first header 100 and the second header 200 and communicated with the first distribution pipe 410, and the first drive assembly 430 is connected with the second end 412 of the first distribution pipe 410 to drive the first distribution pipe 410 to move relative to the at least one of the first header 100 and the second header 200. A pipe wall of the second distribution pipe 450 is provided with a plurality of second distribution holes 453 spaced apart from one another along an axial direction of the second distribution pipe 450. A first end 451 of the second distribution pipe 450 is inserted into or fitted over the first distribution pipe 410, and a second end 452 of the second distribution pipe 450 extends out of the at least one of the first header 100 and the second header 200. The second inlet pipe 460 is located outside the at least one of the first header 100 and the second header 200 and communicated with the second distribution pipe 450, and the second drive assembly 470 is connected with the second end 452 of the second distribution pipe 450 to drive the second distribution pipe 450 to move relative to the first distribution pipe 410.

The following description will focus on an example where the first distribution pipe 410 and the second distribution pipe 450 are disposed within the first header 100. As shown in FIG. 6, the first drive assembly 430 and the second drive assembly 470 are disposed at two ends of the first header 100 respectively, the second end 412 of the first distribution pipe 410 is connected with the first drive assembly 430, and the first end 411 of the first distribution pipe 410 faces towards the second drive assembly 470 and is inserted into the first header 100. The second end 452 of the second distribution pipe 450 is connected with the second drive assembly 470, and the first end 451 of the second distribution pipe 450 faces towards the first drive assembly 430 and is inserted into the first header 100. The first end 411 of the first distribution pipe 410 extends into the second distribution pipe 450 from the first end 451 of the second distribution pipe 450.

Therefore, an overlapping area of the first distribution hole 413 and the second distribution hole 453 may be adjusted to achieve redistribution of the refrigerant flow rate.

In some specific examples, the first communicating chamber body 440 is disposed between the first drive assembly 430 and the first header 100, the second end 412 of the first distribution pipe 410 passes through the first communicating chamber body 440 to be connected with the first drive assembly 430, and the first inlet pipe 420 is connected with the first communicating chamber body 440 and communicated with the first distribution pipe 410 through the first communicating chamber body 440. A second communicating chamber body 480 is disposed between the second drive assembly 470 and the first header 100, the second end 452 of the second distribution pipe 450 passes through the second communicating chamber body 480 to be connected with the second drive assembly 470, and the second inlet pipe 460 is connected with the second communicating chamber body 480 and communicated with the second distribution pipe 450 through the second communicating chamber body 480. In such a way, all the refrigerant flowing out of the first inlet pipe 420 may enter the first distribution pipe 410, and all the refrigerant flowing out of the second inlet pipe 460 may enter the second distribution pipe 450.

The specific structure of the second communicating chamber body 480 may be similar to that of the first communicating chamber body 440, the specific structure of the second distribution pipe 450 may be similar to that of the first distribution pipe 410, the specific structure of the second inlet pipe 460 may be similar to that of the first inlet pipe 420, and the specific structure of the second drive assembly 470 may be similar to that of the first drive assembly 430. For example, the first header 100 may be provided with two refrigerant distribution devices having identical structures.

In an embodiment shown in FIG. 6, the second communicating chamber body 480 and the second inlet pipe 460 may be removed, and hence the refrigerant is introduced into the first header 100 only from the first inlet pipe 420, and the refrigerant distribution is achieved by changing an area of the first distribution holes 413 blocked by the second distribution pipe 450.

In some specific embodiments of the present invention, the first drive assembly 430 drives the first distribution pipe 410 to translate relative to the first header 100 along an axial direction of the first header 100. The plurality of first distribution holes 413 are arranged in a row on the first distribution pipe 410 along the axial direction of the first distribution pipe 410, and the plurality of first distribution holes 413 are not staggered with one another in a circumferential direction of the first distribution pipe 410, i.e. the plurality of first distribution holes 413 are arranged in a straight line. The first drive assembly 430 may be the electronic expansion valve, the electric motor (such as a stepper motor and a linear motor), the air cylinder or the hydraulic cylinder.

For instance, when the operating condition of the heat exchanger 1 changes, the first drive assembly 430 drives the first distribution pipe 410 to move relative to the first header 100 along the axial direction of the first header 100, thus adjusting the flow rates of the refrigerant entering the proximal end and the distal end of the first header 100 through the first distribution holes 413 respectively, so as to achieve the uniform refrigerant distribution.

In some other specific embodiments of the present invention, the first drive assembly 430 drives the first distribution pipe 410 to rotate relative to the first header 100. The first drive assembly 430 may be the electronic expansion valve, the electric motor (e.g. the stepper motor), the air cylinder or the hydraulic cylinder.

The first distribution holes 413 include a first row of distribution holes and a second row of distribution holes, the first row of distribution holes is adjacent to the first end 411 of the first distribution pipe 410, the second row of distribution holes is adjacent to the second end 412 of the first distribution pipe 410, and the first row of distribution holes and the second row of distribution holes are staggered in the circumferential direction of the first distribution pipe 410.

In other words, the first row of distribution holes are arranged from the first end 411 of the first distribution pipe 410 to a length center of the first distribution pipe 410 along the axial direction of the first distribution pipe 410. The second row of distribution holes are arranged from the second end 412 of the first distribution pipe 410 to the length center of the first distribution pipe 410 along the axial direction of the first distribution pipe 410. An imaginary straight line connecting centers of the first row of distribution holes is not intersected with an imaginary straight line connecting centers of the second row of distribution holes, and the first row of distribution holes and the second row of distribution holes face different directions in the circumferential direction of the first distribution pipe 410.

In the following, the refrigerant distribution process of the heat exchanger 1 according to embodiments of the present invention will be described by an example.

When the operating condition of the heat exchanger 1 varies, the original refrigerant distribution scheme cannot meet the refrigerant distribution requirement under the new operating condition. For example, the heat exchange tube 310 around the proximal end of the first header 100 may be supplied with too much liquid, while the heat exchange tube 310 at the distal end of the first header 100 has the insufficient liquid supply or the dry evaporation phenomenon. In such a case, the first distribution pipe 410 may be driven by the first drive assembly 430 to rotate relative to the first header 100, so as to reduce an area of the first distribution holes 413 directly facing the heat exchange tubes 310, in which the first distribution holes 413 are at a side of the first distribution pipe 410 close to the proximal end of the first header 100, and meanwhile to enlarge an area of the first distribution holes 413 directly facing the heat exchange tubes 310, in which the first distribution holes 413 are at another side of the first distribution pipe 410 close to the distal end of the first header 100, thereby reducing the refrigerant flow rate at the proximal end of the first header 100 and increasing the refrigerant flow rate at the distal end of the first header 100, so as to achieve the purpose of uniform refrigerant distribution.

Figure 8:
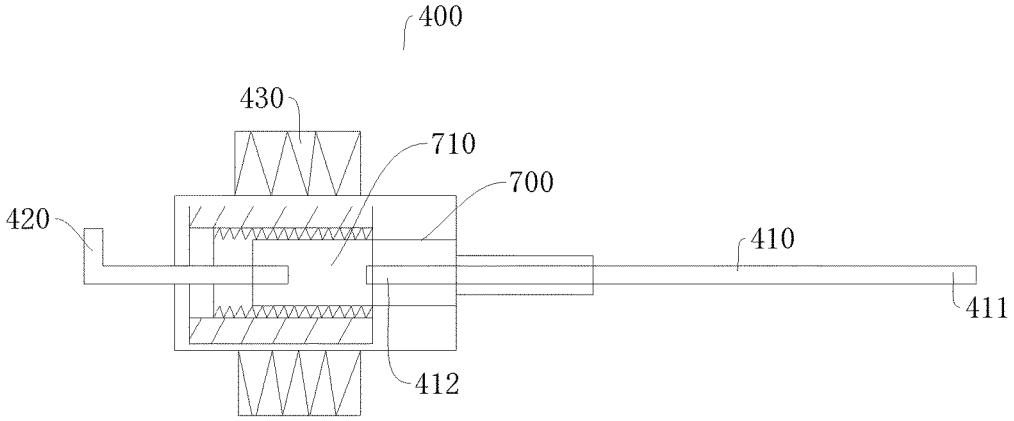
FIG. 8 is a schematic view of a refrigerant distribution device according to another embodiment of the present invention.

In some specific examples of the present invention, as shown in FIG. 8, the first drive assembly 430 is the stepper motor. The first inlet pipe 420 coincides with an axis of the first distribution pipe 410 and is communicated with the first distribution pipe 410 through a connector 700.

The first distribution pipe 410 is fixedly connected with the connector 700, the second end 412 of the first distribution pipe 410 is inserted into a cavity 710 inside the connector 700 by a certain distance, and the second end 412 of the first distribution pipe 410 is not closed but in communication with the cavity 710 of the connector 700, such that the refrigerant inside the cavity 710 can enter an interior of the first distribution pipe 410 along a straight line.

The refrigerant distribution device 400 may not only achieve the uniform refrigerant distribution by rotating the first distribution pipe 410, but also increase the degree of uniform mixing of the gas-liquid two-phase refrigerant in the first header 100 through the rotational motion of the first distribution pipe 410, such that the refrigerant entering each heat exchange tube 310 of the heat exchanger 1 have substantially same mass and flow rate, thereby improving the heat exchange performance.

Specifically, the gas-liquid two-phase refrigerant enters the first distribution pipe 410 through the first inlet pipe 420 and the cavity 710 of the connector 700. The gas-liquid two-phase refrigerant enters the first header 100 through the first distribution holes 413 of the first distribution pipe 410. When the stepper motor rotates clockwise or counterclockwise, the degree of uniform mixing of the gas-liquid two-phase refrigerant in the first header 100 can be increased.

In some other specific examples of the present invention, the first distribution holes 413 are spirally arranged along the axial direction of the first distribution pipe 410. When the first distribution pipe 410 rotates under the drive of the first drive assembly 430, the respective areas of the plurality of first distribution holes 413 directly facing the plurality of heat exchange tubes 310 can be adjusted to adjust the flow rates of the refrigerant entering the corresponding heat exchange tubes 310 from the plurality of first distribution holes 413, thereby achieving the uniform refrigerant distribution. The heat exchanger according to embodiments of the present invention may adjust the refrigerant distribution according to the practical operating conditions thereof, thus satisfying the requirement for the uniform refrigerant distribution under different operating conditions, and eliminating the need for mounting and dismounting, testing and redesigning processes of conventional distribution pipes, so as to reduce the development time and the cost. The heat exchanger according to embodiments of the present invention is for example the parallel flow heat exchanger (e.g. the microchannel heat exchanger).

In the specification, it is to be understood that terms such as "central," "longitudinal", "lateral", "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation or the position as then described or as shown in the drawings under discussion. These relative terms are only used to simplify description of the present invention, and do not indicate or imply that the device or element referred to must have a particular orientation, or constructed or operated in a particular orientation. Thus, these terms cannot be constructed to limit the present invention.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present invention. Thus, the appearances of the above phrases throughout this specification are not necessarily referring to the same embodiment or example of the present invention. Furthermore, the particular features, structures, materials, or characteristics may be combined in any suitable manner in one or more embodiments or examples.

Although embodiments of the present invention have been shown and described, it would be appreciated by those skilled in the art that changes, modifications, alternatives and variations can be made in the embodiments without departing from the scope of the present invention. The scope of the present invention is defined by the claims and the like.

What is claimed is:

1. A heat exchanger, comprising:

a first header and a second header;

a heat exchanger core comprising a heat exchange tube and a fin, wherein two ends of the heat exchange tube are connected with the first header and the second header respectively, and the fin is disposed between adjacent heat exchange tubes; and a refrigerant distribution device comprising a first distribution pipe, a first inlet pipe and a first drive assembly, wherein a pipe wall of the first distribution pipe is provided with first distribution holes, the first distribution pipe is inserted into at least one of the first header and the second header, the first inlet pipe is located outside the at least one of the first header and the second header and fluidly communicated with the first distribution pipe, and the first drive assembly drives the first distribution pipe to move relative to the at least one of the first header and the second header.

2. The heat exchanger as set forth in claim 1, further comprising a temperature sensor disposed to the heat exchanger core and connected with the first drive assembly, wherein the first drive assembly drives the first distribution pipe to move according to a temperature detected by the temperature sensor.

3. The heat exchanger as set forth in claim 2, where a plurality of temperature sensors are provided, spaced apart from one another, and disposed at different positions on the heat exchanger core, and the first drive assembly drives the first distribution pipe to move according to a difference of temperatures detected by the plurality of temperature sensors.

4. The heat exchanger as set forth in claim 1, wherein the refrigerant distribution device further comprises a first communicating chamber body, the first communicating chamber body defines a first communicating chamber therein, the first distribution pipe passes through the first communicating chamber body to be connected with the first drive assembly, the first distribution pipe is in communication with the first communicating chamber, and the first inlet pipe is connected with the first communicating chamber body and communicated with the first distribution pipe through the first communicating chamber.

5. The heat exchanger as set forth in claim 1, wherein the refrigerant distribution device further comprises a fixed distribution pipe disposed inside the at least one of the first header and the second header and provided with fixed distribution holes, wherein the first distribution pipe is inserted into the fixed distribution pipe and moves relative to the fixed distribution pipe under the drive of the first drive assembly.

6. The heat exchanger as set forth in claim 1, wherein the refrigerant distribution device further comprises a second distribution pipe, a second inlet pipe, and a second drive assembly, wherein a pipe wall of the second distribution pipe is provided with second distribution holes, the second distribution pipe is inserted into or fitted over the first distribution pipe, the second inlet pipe is located outside the at least one of the first header and the second header and communicated with the second distribution pipe, and the second drive assembly drives the second distribution pipe to move relative to the first distribution pipe.

7. The heat exchanger as set forth in claim 1, wherein the first drive assembly comprises one of an electronic expansion valve, an electric motor, an air cylinder or a hydraulic cylinder.

8. The heat exchanger as set forth in claim 1, wherein the first drive assembly comprises:

a stator;

a rotor rotatably disposed within the stator and having threads in an inner surface thereof; and a moving member threadedly fitted with the rotor and that moves through rotation of the rotor.

9. The heat exchanger as set forth in claim 1, wherein the first drive assembly drives the first distribution pipe to translate relative to the at least one of the first header and the second header along an axial direction thereof.

10. The heat exchanger as set forth in claim 1, wherein the first drive assembly drives the first distribution pipe to rotate relative to the at least one of the first header and the second header.

11. The heat exchanger as set forth in claim 10, wherein the first distribution holes comprise a first row of distribution holes adjacent to a first end of the first distribution pipe and a second row of distribution holes adjacent to a second end of the first distribution pipe, and the first row of distribution holes are staggered with the second row of distribution holes in a circumferential direction of the first distribution pipe.

12. A refrigerant distribution device, comprising a distribution pipe, an inlet pipe and a drive assembly, wherein a pipe wall of the distribution pipe is provided with distribution holes, the inlet pipe is in fluid communication with the distribution pipe, and the drive assembly drives the distribution pipe to move.

13. The refrigerant distribution device as set forth in 12, wherein the refrigerant distribution device further comprises a communicating chamber body, the communicating chamber body defines a communicating chamber therein, the distribution pipe passes through the communicating chamber body to be connected with the drive assembly, the distribution pipe is in communication with the communicating chamber, and the inlet pipe is connected with the communicating chamber body and communicated with the distribution pipe through the communicating chamber.

14. The refrigerant distribution device as set forth in claim 12, wherein the refrigerant distribution device further comprises a fixed distribution pipe provided with fixed distribution holes, the distribution pipe is inserted into the fixed distribution pipe and moves relative to the fixed distribution pipe under the drive of the drive assembly.

15. The refrigerant distribution device as set forth in claim 12, wherein the drive assembly comprises one of an electronic expansion valve, an electric motor, an air cylinder or a hydraulic cylinder.

16. The refrigerant distribution device as set forth in claim 12, wherein the drive assembly comprises:

a stator;

a rotor rotatably disposed within the stator and having threads in an inner surface thereof; and a moving member threadedly fitted with the rotor and that moves through rotation of the rotor.

17. The refrigerant distribution device as set forth in claim 12, wherein the drive assembly drives the distribution pipe to translate and/or rotate.

* * * * *